US006550616B2

(12) United States Patent
Le Bras

(10) Patent No.: US 6,550,616 B2
(45) Date of Patent: Apr. 22, 2003

(54) CARTON AND CARTON BLANK

(75) Inventor: Philippe Le Bras, Chateauroux (FR)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 09/920,905

(22) Filed: Aug. 2, 2001

(65) Prior Publication Data

US 2002/0017476 A1 Feb. 14, 2002

Related U.S. Application Data

(63) Continuation of application No. PCT/US00/02960, filed on Feb. 4, 2000.

(51) Int. Cl.[7] ..... B65D 75/08; B65D 75/18
(52) U.S. Cl. ..... 206/434; 206/427
(58) Field of Search ..... 206/427, 434; 229/117, 183

(56) References Cited

U.S. PATENT DOCUMENTS

| | | | | |
|---|---|---|---|---|
| 2,600,954 A | * | 6/1952 | Bardet | 493/172 |
| 2,936,069 A | | 5/1960 | Dunning | 206/427 |
| 3,115,073 A | * | 12/1963 | Kreimendahl | 493/128 |
| 3,486,421 A | * | 12/1969 | Franson | 493/221 |
| 3,767,042 A | | 10/1973 | Ganz | 206/197 |
| 3,776,376 A | | 12/1973 | Arneson | 206/196 |
| 4,215,781 A | | 8/1980 | Humphries et al. | 206/434 |
| 5,131,588 A | | 7/1992 | Oliff | 229/198.2 |
| 5,180,054 A | | 1/1993 | Bakx | 206/140 |
| 5,297,673 A | | 3/1994 | Sutherland | 206/147 |
| 5,542,536 A | | 8/1996 | Sutherland | 206/427 |
| 5,551,556 A | | 9/1996 | Sutherland | 206/147 |
| 5,597,071 A | | 1/1997 | Sutherland | 206/434 |

FOREIGN PATENT DOCUMENTS

| | | |
|---|---|---|
| GB | 1 380 240 | 1/1975 |
| GB | 2 006 708 A | 5/1979 |

* cited by examiner

*Primary Examiner*—David T. Fidei
(74) *Attorney, Agent, or Firm*—Tsugihiko Suzuki

(57) ABSTRACT

An article carrier and a blank for an article carrier for holding articles with tapered sides, for example connected plastic cups, comprising a top wall, opposed side walls and a base wall hingedly connected together to form a tubular structure. An article retention structure is hingedly connected to one of the side walls and the base panel. The article retention structure is formed by a plurality of panels including a side end flap so constructed and arranged to taper inwardly towards the base wall to substantially conform to the shape of an adjacent article.

12 Claims, 11 Drawing Sheets

CARTON AND CARTON BLANK

This is a continuation of international application No. PCT/US00/02960, filed Feb. 4, 2000, which is hereby incorporated by reference.

BACKGROUND OF THE INVENTION

This invention relates generally to a carton having an end retention feature and more particularly to a wraparound type article carrier designed for articles such as connected plastic cups containing yoghurt or other similar foodstuff.

The prior art illustrates wraparound cartons with end closure panels for closing the ends of the carton that are connected to respective side and base panels by a series of gusset panels that assist in forming the end closure panels. There are many arrangements of gusset panels, examples of which are shown in U.S. Pat. No. 5,180,054, FR-A-1 44 536. Prior art structures illustrate carriers for carrying articles with planar sides for example cans or bottles and end retention structures are therefore formed in a planar relationship with respective sides and ends of the corner.

When articles with inclined side walls or articles provided with flanges, for example yoghurt pots, are packaged in groups a spacing is formed between adjacent articles, thereby allowing relative movement between adjacent articles within the carton which is undesirable. Prior art carriers do not provide satisfactory retention for articles of this type. Another problem associated with the prior art relates to retention of the gusset panels within the carrier when the articles are free to move within it.

Another aspect of the invention relates generally to an arrangement and method for securing at least three panels in an overlapping relationship.

It is well known in the art to secure two panels, for example base panels of a wraparound carton in an overlapping relationship using glue. As the construction of cartons becomes more advanced, it is often necessary to secure together three or more panels in end retention arrangements, for example. If this is the case, then glue must be applied to two separate panel surfaces in order to secure all of the panels together. This additional application of glue may increase the total amount of glue required, and furthermore adds to the complexity of the carton erection process, possibly requiring the use of additional machinery. The erection process may also be slowed, thus reducing its overall efficiency.

The present invention and its preferred embodiments seek to overcome or at least mitigate the problems of the prior art.

SUMMARY OF THE INVENTION

One aspect of the invention provides an article carrier for holding articles, for example connected plastic cups, comprising a top wall, opposed side walls and a base wall hingedly connected together to form a tubular structure and wherein there further comprises an article retention structure hingedly connected to one of the side walls and the base panel, which article retention structure is formed by a plurality of panels including a side end flap so constructed and arranged to taper inwardly towards the base to substantially conform to the shape of an adjacent article.

A second aspect of the invention provides an article carrier for holding articles with tapered sides, for example connected plastic cups, comprising a top wall, opposed side walls and a base wall hingedly connected together to form a tubular structure and wherein there further comprises an article retention structure hingedly connected to one of the side walls and the base wall, which article retention structure is formed by a plurality of panels including at least one side end flap so constructed and arranged to be disposed in a twisted condition to substantially conform to the shape of an adjacent article.

According to an optional feature of either aspect of the invention, the article retention structure may further comprise a base end flap connected to the side end flap by a gusset panel and wherein the base end flap is hingedly connected to the base panel and adapted to underlie an outer article so that the side end flap is retained in a set up condition.

According to another optional feature of either aspect of the invention, the base end flap may further comprise a tab shaped to underlie the article and to prevent its release during distortion of the carton thereby to maintain the side end flap in a set up condition. Preferably, the tab may be defined by a side and end edge of the bottom end flap and by a slit between the bottom end flap and the gusset, which slit terminates at the fold line connecting the bottom of the flap to the gusset.

According to another optional feature of either aspect of the invention the bottom end flap may be connected to a bottom panel by a fold line which fold line defines an acute angle with the lower edge of the adjacent side wall thereby to maximise the length of the bottom end flap that underlies the article.

According to another optional feature of either aspect of the invention the fold line between the side end flap and the adjacent carton side wall may be curved to impart inward bowing to the side end flap.

According to another optional feature of either aspect of the invention the fold line connecting the side end flap to the gusset may be angled with respect to the edge of the side wall to compensate for the panel arrangement in a set up condition thereby to maintain the gusset panel and bottom end panel in a substantially flat arrangement with the base panel.

A third aspect of the invention provides an article retention structure for retaining articles within a tubular carton, which article retaining structure comprises a side end flap hingedly connected to the side wall by an arcuate fold line, a bottom end flap hingedly connected to the base panel and a gusset panel hingably connecting the side end flap to the base end flap wherein the fold line connecting the base end flap to the gusset panel is co-linear with an imaginary line tangent to the arcuate fold line.

According to an optional feature of the third aspect of the invention there may further comprise an aperture struck from a portion of the base end flap, wherein an edge for which aperture interrupts the gusset fold line and is co-linear with the imaginary line.

According to another optional feature of the third aspect of the invention the fold line interconnecting the side end flap with the gusset may be offset the lower edge of the side wall panel to compensate for the panel arrangement in a set up condition thereby to maintain the gusset panel and bottom end panel in a substantially flat arrangement with the base panel.

A fourth aspect of the invention provides a carton blank for forming an article carrier for holding articles with tapered sides, for example connected plastic cups, comprising a top panel, first side wall panel, base and a second side wall panel hingedly connected together in series, wherein there further comprises a article retention structure hingedly connected to at least one of the side wall panel and the base panel, which article retention structure is formed by a plurality of panels including a side end flap so constructed and arranged to taper inwardly towards the base panel to substantially conform to the shape of an adjacent article held in a set up carton.

A fifth aspect of the invention provides an arrangement for securing a triple ply structure comprising an intermediate panel between a first panel and a second panel, wherein an aperture is provided in the intermediate panel such that glue applied to an inner face of the first panel in register with the aperture secures together the first, second and intermediate panels when placed together in face contacting relationship.

Preferably, the first panel may be provided by a folded portion of the intermediate panel, the folded portion at least partially overlying the aperture.

According to an optional feature of this aspect of the invention a second intermediate panel may be provided by a folded portion of the second panel. Preferably, the second intermediate panel may be further provided with an aperture in register with the first aperture such that the first panel is secured directly to the second panel.

A sixth aspect of the invention provides an article carrier comprising a top wall, opposed side walls and a base wall hingedly connected together to form a tubular structure, wherein the base wall is a composite comprising three panels, the panels being secured together.

A seventh aspect of the invention provides a method of securing together a first panel, a second panel, and an intermediate panel in overlapping relationship comprising the steps of, providing an aperture in the intermediate panel, placing the first and the intermediate panel in face contacting relationship, applying glue to at least an area of the outer panel accessible through the aperture, placing the second panel in face contacting relationship with the intermediate panel such that the glue contacts the inner face of the second panel.

According to an optional feature of this aspect of the invention glue may be additionally applied to the free face of the intermediate panel.

An eighth aspect of the invention provides a blank for forming an article carrier comprising a top wall panel, opposed side wall panels, a first base wall panel and a second base wall panel hingedly connected together to form a tubular structure when erected, wherein the first base wall panel has a flap folded to be in face contacting relationship thereto, thereby forming a composite base wall comprising three panels, the panels being secured together.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
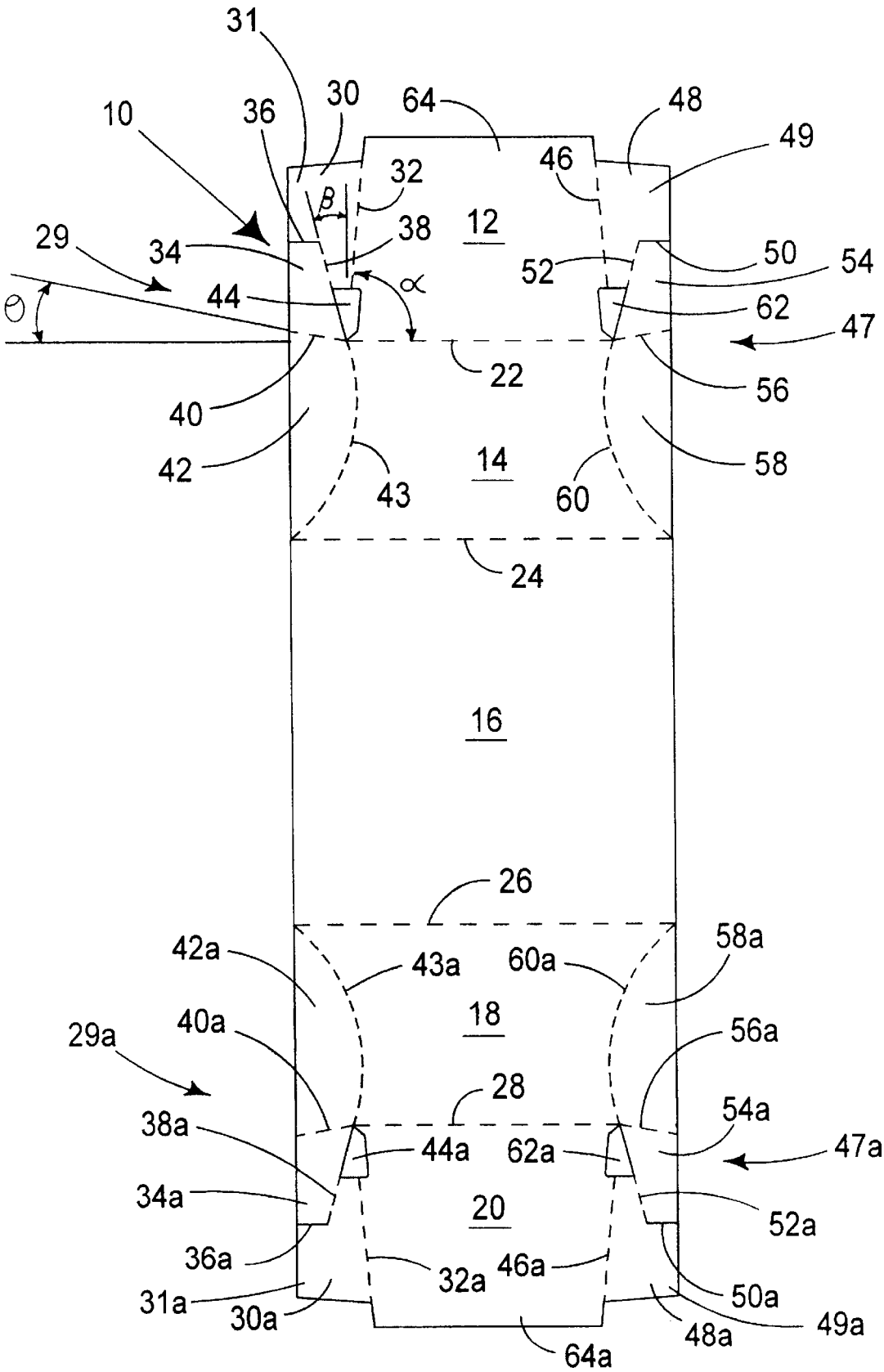
FIG. 1 illustrates blank for forming a carton according to an aspect of the invention.
Figure 2:
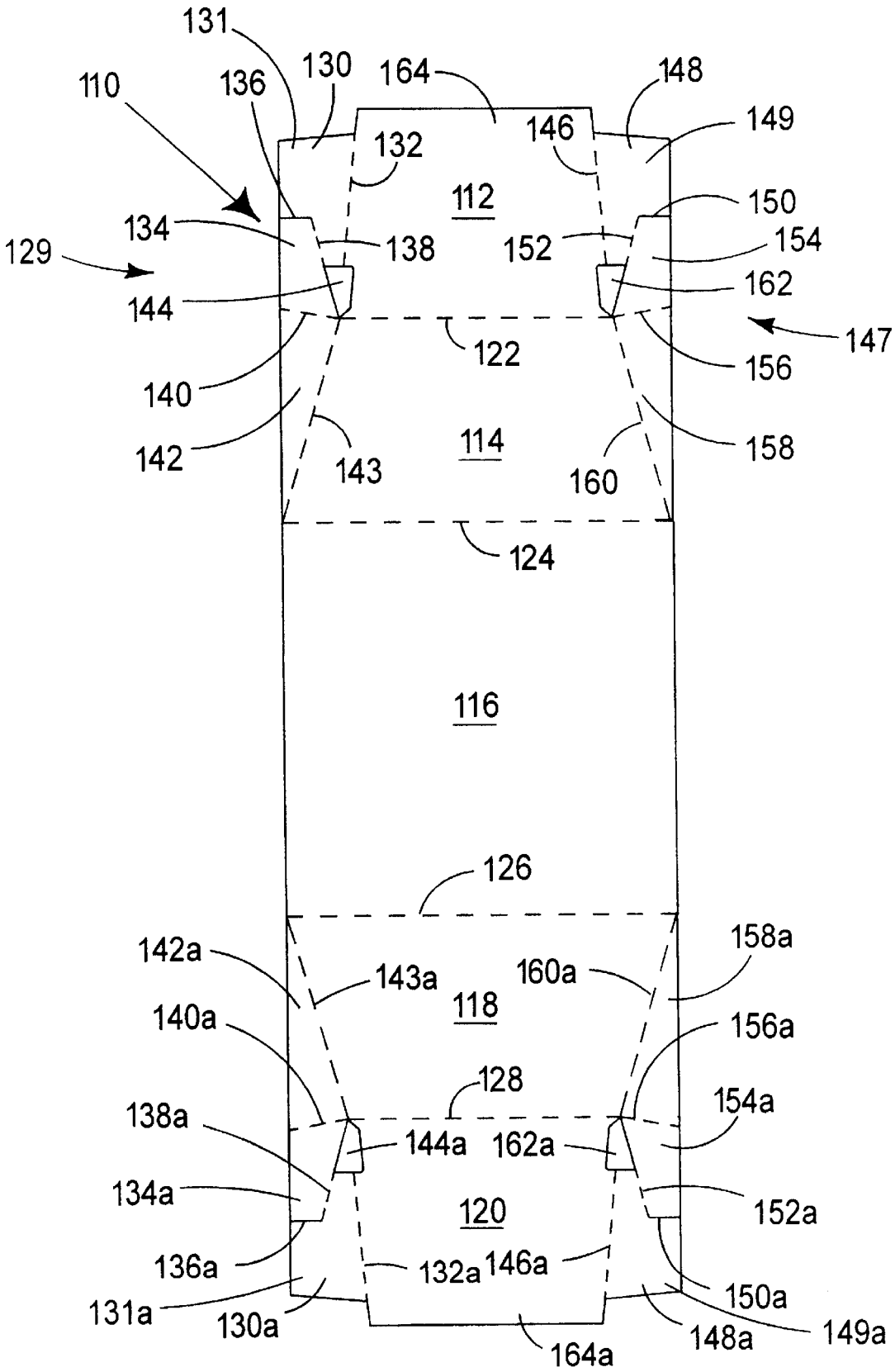
FIG. 2 illustrates the second embodiment of a blank for forming a carton according to an aspect of the invention.

Referring to the drawings, and in particular FIGS. 1 and 2, there is shown two embodiments of a blank for forming a carton made from paperboard or similar foldable sheet material. In these embodiments, wraparound type cartons can be formed from the blanks although the invention can be applied to other carton types, for example end loading cartons, without departing from the invention. Furthermore, it will be recognised that rather than the bottom wall being formed from the interlocked panels, the carton blank may be rearranged whereby some other wall such as a top wall or a side wall is formed from the interlocked panels.

Turning to the first embodiment shown in FIG. 1 the blank 10 comprises a first base panel 12, first side wall panel 14, top panel 16, second side wall panel 18, second base panel 20 hingedly connected one to the next in series along fold lines 22, 24, 26 and 28 respectively.

A series of panels for forming an article retention structure is provided at one or each end of the carton. The article retention arrangement 29 at one corner of side and base panels 12, 14 comprises a bottom end flap 30 hingedly connected to base panel 12 along fold line 32. There further comprises a side end flap 42 hingedly connected to side wall panel 14 along fold line 43. In this embodiment, the fold line 43 is curved to impart inward bowing to the side end flaps when the carton is set up. Side end flap 42 and base end flap 30 are interconnected by a gusset panel 34. It will be seen from FIG. 1 that gusset panel 34 is hingedly connected to base end flap 30 along fold line 38 and to side end flap 42 along fold line 40. Preferably, fold line 38 is co-linear with an imaginary line tangent to and extending beyond fold line 43.

Base end flap 30 may further comprise a tab portion 31 defined in part by the end and side edges of flap 30 and by cut line 36 which terminates at foldline 38. In use, tab portion 31 is adapted to be retained between the base panel 12 and an outer article to retain the side end flap 42 in a set up condition.

A stress relief aperture 44 may be provided. FIG. 1 shows an example of a stress relief aperture 44 which is struck from base end flap 30 and, preferably, extends into base panel 12. It is preferable that aperture 44 does not extend into gusset panel 34, instead an edge of aperture 44 is co-linear with fold line 38. This feature leads to a reduction of stress when folding base end flap 30 and gusset panel 34. Furthermore, gusset panel 34 does not tend to be distorted during set up process which leads to improved folding along fold lines 38 and 40.

Likewise, the opposing side of base and side wall panels 12 and 14 there may further comprise a similar article retention arrangement 47 comprising a base end flap 48 hingedly connected to base panel 12 along fold line 46.

There further comprises a side end flap 58 hingedly connected to side wall panel 14 along fold line 60. In this embodiment, the fold line 60 is curved to impart inward bowing to the side end flaps when the carton is set up. Side end flap 58 and base end flap 48 are interconnected by a gusset panel 54. It will be seen from FIG. 1 that gusset panel 54 is hingedly connected to base end flap 48 along fold line 52 and to side end flap 58 along fold line 56. Preferably, fold line 52 is co-linear with an imaginary line tangent to and extending beyond fold line 60.

Base end flap 48 may further comprise a tab portion 49 defined in part by the end and side edges of flap 48 and by cut line 50 which terminates at foldline 52. In use, tab portion 49 is adapted to be retained between the base panel 12 and an outer article to retain the side end flap 58 in a set up condition.

A similar stress relief aperture 62 to stress relief aperture 44 may be provided which in this embodiment is struck from base end flap 48 and, preferably, extending into base panel 12.

In one class of embodiments, fold lines 32 and 38 defining the base end flap 30 of article retaining structure 29 may diverge away from a point of intersection with fold lines 40 and 43 so that fold line 32 defines an acute angle $\alpha$ with fold line 22, preferably, 85 degrees and fold line 38 is offset by a suitable angle $\beta$, for example 15 degrees from a notional line perpendicular to fold line 22. Optionally, the fold line 40 connecting the gusset panel 34 to the side end flap 42 may define an acute angle *h* with respect to a notional extension of fold line 22 to compensate for the panel arrangement in a set up condition. Preferably, the acute angle ∪ may, for example, be 10 degrees which corresponds substantially to the angle—(FIG. 3) of the side wall panel with respect to a notional vertical line Y—Y and/or corresponds to the difference between the bottom of the cup and the top flange of the cup. Of course, the article retention structure 47 would be adapted accordingly to correspond to article retention structure 29.

Other configurations are envisaged, and in particular different configurations of fold lines 32, 38 and 40, and corresponding fold lines 46, 52 and 56 so that the side end flaps 42, 58 can be tapered inwardly towards the base 12, 22 to a greater or lesser extent to conform to the shape of a different profile of article. In some embodiments, the degree of twisting imparted on the side end flaps 42, 58 can be altered by changing the relative position of any one or each of the fold lines 32, 38, 40.

It will be seen from FIG. 1*a* that the end closure structures formed from panels 18 and/or 20 are designated by corresponding reference numerals with the addition of letter "a" because they are substantially identical to the end retention structures formed from panels 12 and 14 described above, and are not therefore described in any more detail.

Turning to the second embodiment shown in FIG. 2, the blank 110 is similar to the first embodiment and therefore like panels are designated by the same reference numeral but are prefixed with the numeral "1". Therefore only the differences are described in any greater detail.

It will be seen that in the second embodiment, the fold line 143 and 160 are straight and extend from the upper edge of side wall panel 114 to terminate at the intersection of fold lines 140, 122 and 156, 122 respectively. Thus, the side end flaps 142 and 158 are substantially triangular in configuration. The side end flaps 142, 158 function in identical manner to the side end flaps of the first embodiment. Aside from these differences, the end retention structures are formed from similar panels and are constructed in the same way as the first embodiment.

Turning to the construction of the carton from a carton blank as illustrated in FIG. 1, the blank 10 requires a series of sequential folding and gluing operations which is preferably performed in a straight line machine so that the carton is not required to be rotated or inverted to complete its construction. The folding process is not limited to that described below and can be altered according to particular manufacturing requirements.

The carton is applied to an array of articles, for example four arranged in a two by two formation, whereby the top panel 16 is supported by the tops of the articles. The side wall panels 14 and 18 are then folded out of alignment with top panel 16 along fold lines 24, 26 and base panels 12, 20 are folded out of alignment with side wall panels 14, 18 respectively along fold lines 22, 28 so that side and base panels 14, 18 and 12, 20 are folded towards each other. As side wall panels 14, 18 and base panels 12, 20 continue to be folded the construction of the end retention structures take place.

Each article retention structure is formed in a substantially like manner so only the construction of article retention structure 29 will now be described. It is usual for the structures on a blank to be formed at substantially the same time by a suitable arrangement of guides and/or locating means.

Thus, article retention structure 29 is formed by first folding base end flap 30 about fold line 32 such that base end flap is folded into face contacting relationship with base panel 12. This action causes gusset panel 34 to be folded out of alignment with base end flap 30 about fold line 38 and is drawn inwardly towards base panel 12 until a portion of the outer face of gusset panel 34 overlies base end flap 30.

Figure 3:
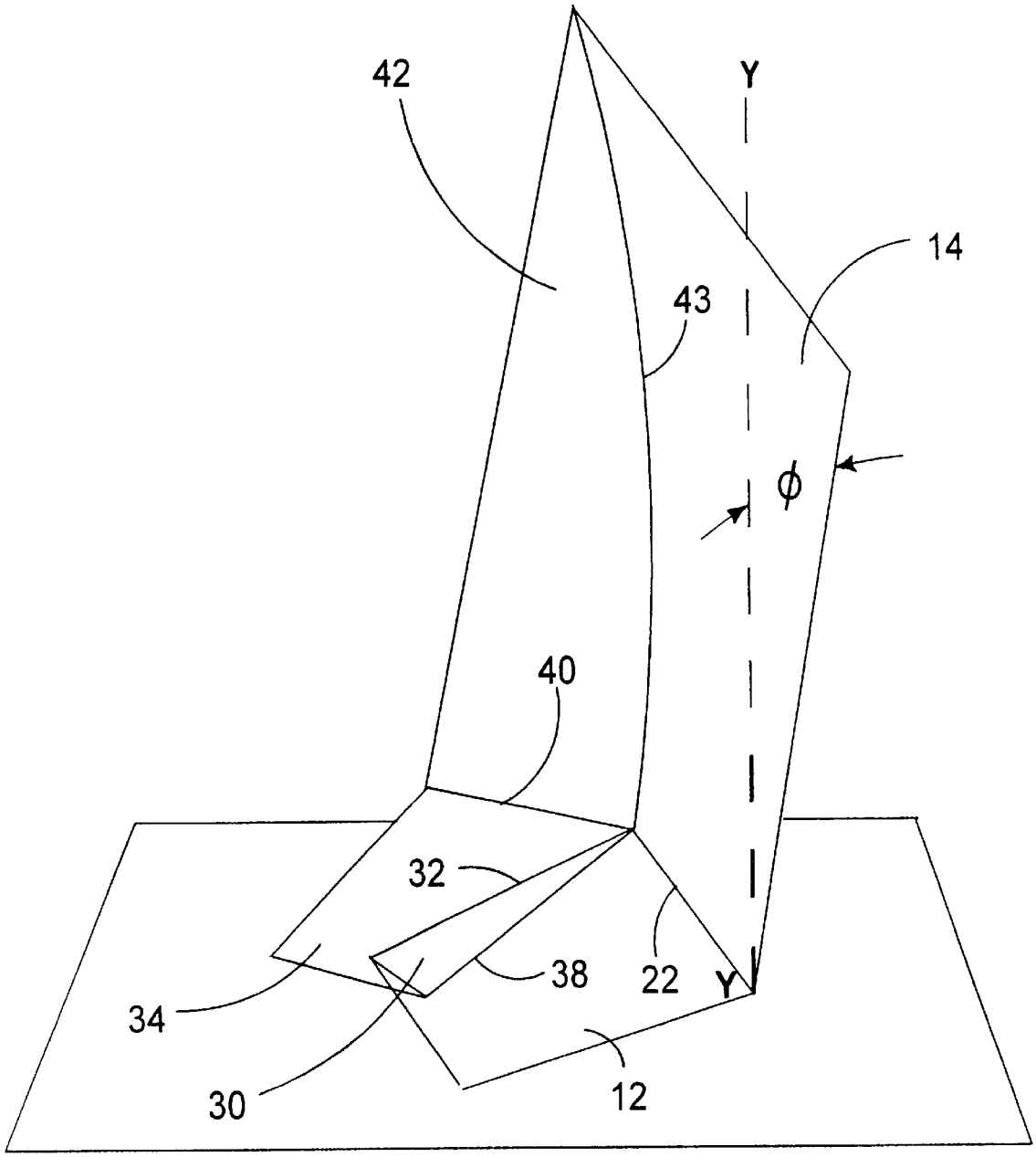
FIG. 3 is an enlarged perspective view of a portion of the end retention panels and gusset arrangement viewed from within the carton formed from the blank shown in FIG. 1*a;*

As gusset panel 34 is drawn inwards towards base panel 12 it is folded out of alignment with side end flap 42 along fold line 40 into a substantially perpendicular relationship which causes side end flap to be moved out of alignment with side wall panel 14 and into an obtuse, angular relationship along fold line 43. Thus, the side end flap 42 is caused to taper inwardly towards the base panel 12 as shown in FIG. 3. In this embodiment, the curved fold line 43 causes side end flap 42 to bow inwardly to conform to the shape of the article to be held by the carrier. Optionally the base end flap 30 and the gusset panel 34 can be secured to the base panel 12 by glue or other suitable means or by another aspect of the invention described below.

As shown in FIG. 3, the angle of incline $\phi$ of side wall panel 14 with respect to a notional vertical plan Y—Y is adjusted by changing the angle $\partial$ (FIG. 1) of fold line 40.

It will also be seen that in this embodiment end flap 42 is caused to be in a twisted condition to conform to the shape of the article.

The other article retention structures are also formed in the same manner as described in the preceding two paragraphs.

Figure 4A:
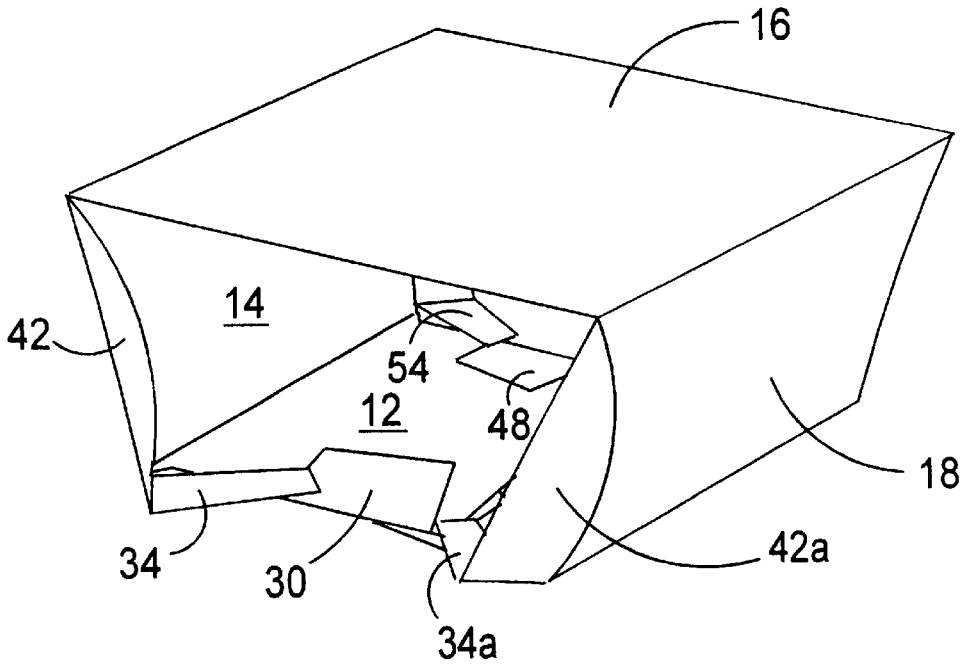
FIGS. 4*a* and 4*b* illustrate the cartons formed from the blanks shown in FIGS. 1*a* and 1*b* respectively.

Thereafter, the folding of side and base panels 12, 14 and 20, 18 is completed so that a portion 64 (FIG. 1) of base panel 12 is placed into face contacting relationship with a corresponding overlapping portion 64*a* (FIG. 1) of base panel 20 and is secured together to form a base structure, by glue or other means known in the art as illustrated in FIG. 4*a*.

Figure 4B:
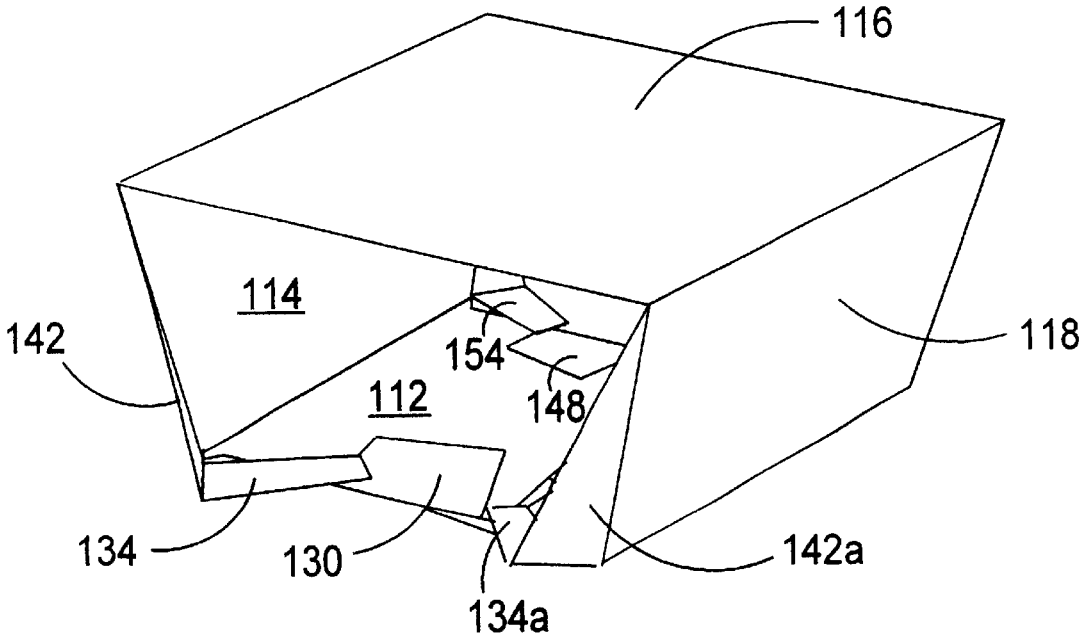

The construction of the second embodiment shown in FIG. 2 is substantially the same as that described above to produce a carton shown in FIG. 4*b*.

Figure 5:
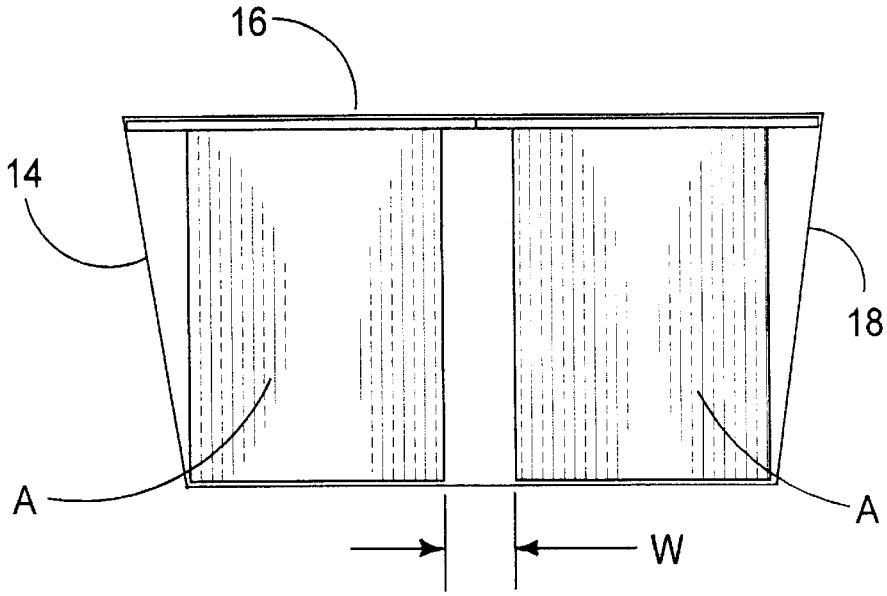
FIGS. 5 and 6 illustrate examples of known cartons loaded with plastic cups in stored and deflected positions.
Figure 6:
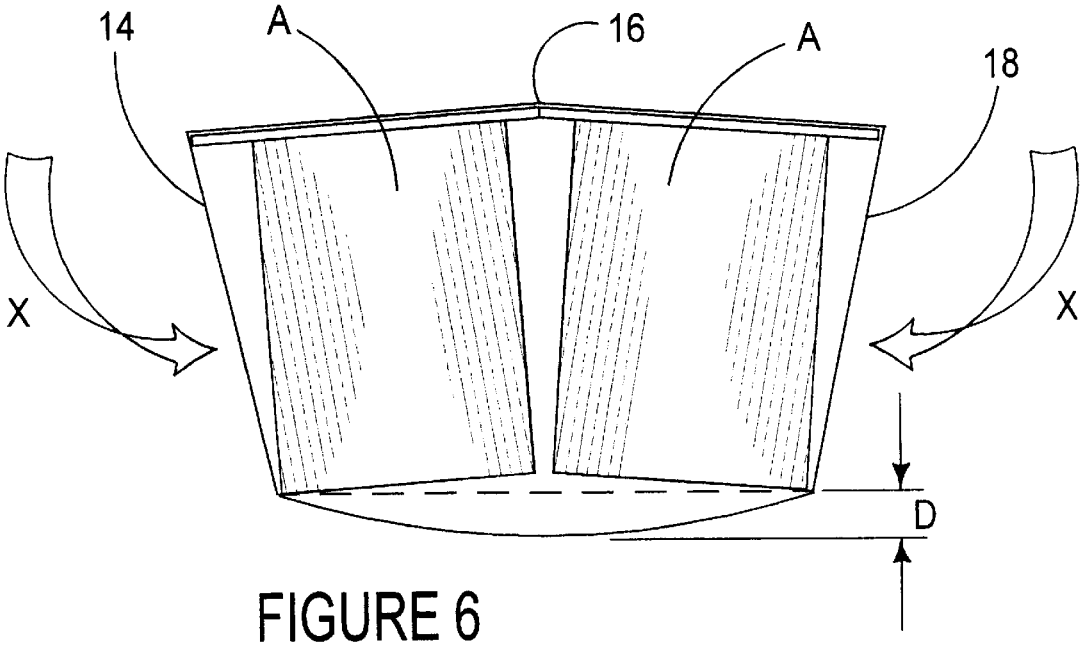

FIGS. 5 and 6 show an example of known article carriers for example yoghurt pots that have flanges and are connected along their tops. In the usual stored position shown in FIG. 4, there is a gap (W) between the lower portions of adjacent articles. When the loaded carton is lifted the articles tend to move towards each other in direction X, shown in FIG. 6 and thereby distort the carton.

In view of the distortion of the above known article carrier, the tab portion 31 of the embodiment of FIG. 1 may be of the size such that the width of base end flap 30 is greater than the distance D of distortion shown in FIG. 6. Alternatively, fold line 32 may be slanted so that the free end edge of base end flap 30 is at an angle with respect to fold line 32. This may increase the effective width of base end flap 30 because it is the corner of base end flap 30 that is placed at the inner most point rather than the free end edge thereof as shown in FIG. 4*a*. This arrangement allows the article retention structures to remain intact even when the carton is distorted. This is because base end flaps 30, 48, 30*a*, 48*a* are prevented by the articles from being outwardly moved to release the articles retention structure. The tab portion of the embodiment of FIG. 2 may also be subject to the above arrangement to allow its retention structures to remain intact.

Figure 7:
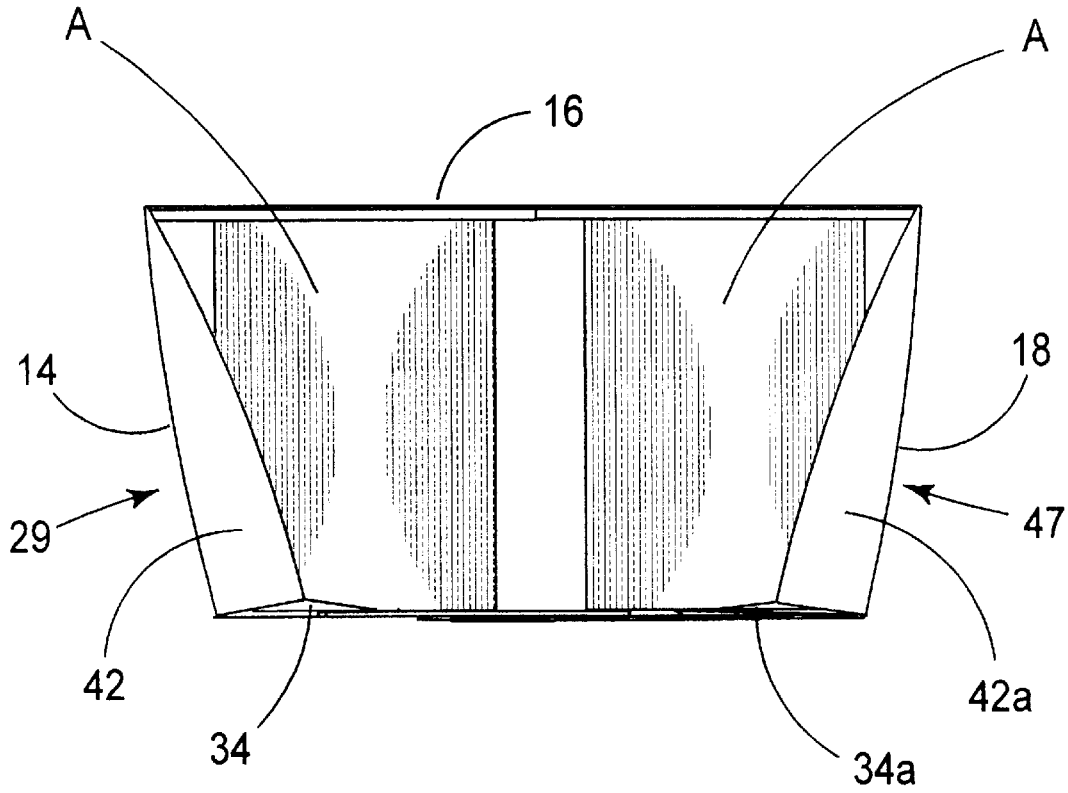
FIG. 7 illustrates the carton shown in FIG. 4*a* loaded with articles.

FIG. 7 illustrates a carton formed from a blank of the first embodiment shown in FIG. 1. More particularly, there is illustrated an article carrier for holding articles, for example connected plastic cups, comprising a top wall 16, opposed side walls 14, 18 and a base 12, 20 hingedly connected together to form a tubular structure and wherein there further comprises article retention means 29 hingedly connected to one of the side walls 14 and the base 12, which article retention means is formed by a plurality of panels including a side end flap 42 so constructed and arranged to taper inwardly towards the base to substantially conform to the shape of an adjacent article A.

Another aspect of the invention is illustrated in FIGS. 8 to 12 in which there is shown an arrangement for securing a triple ply structure comprising an intermediate panel 212 between a first panel 230 and a second panel 220, wherein an aperture H1 is provided in the intermediate panel such that glue G applied to an inner face of the first panel in register with the aperture secures together the first, second and intermediate panels when placed together in face contacting relationship.

Figure 8:
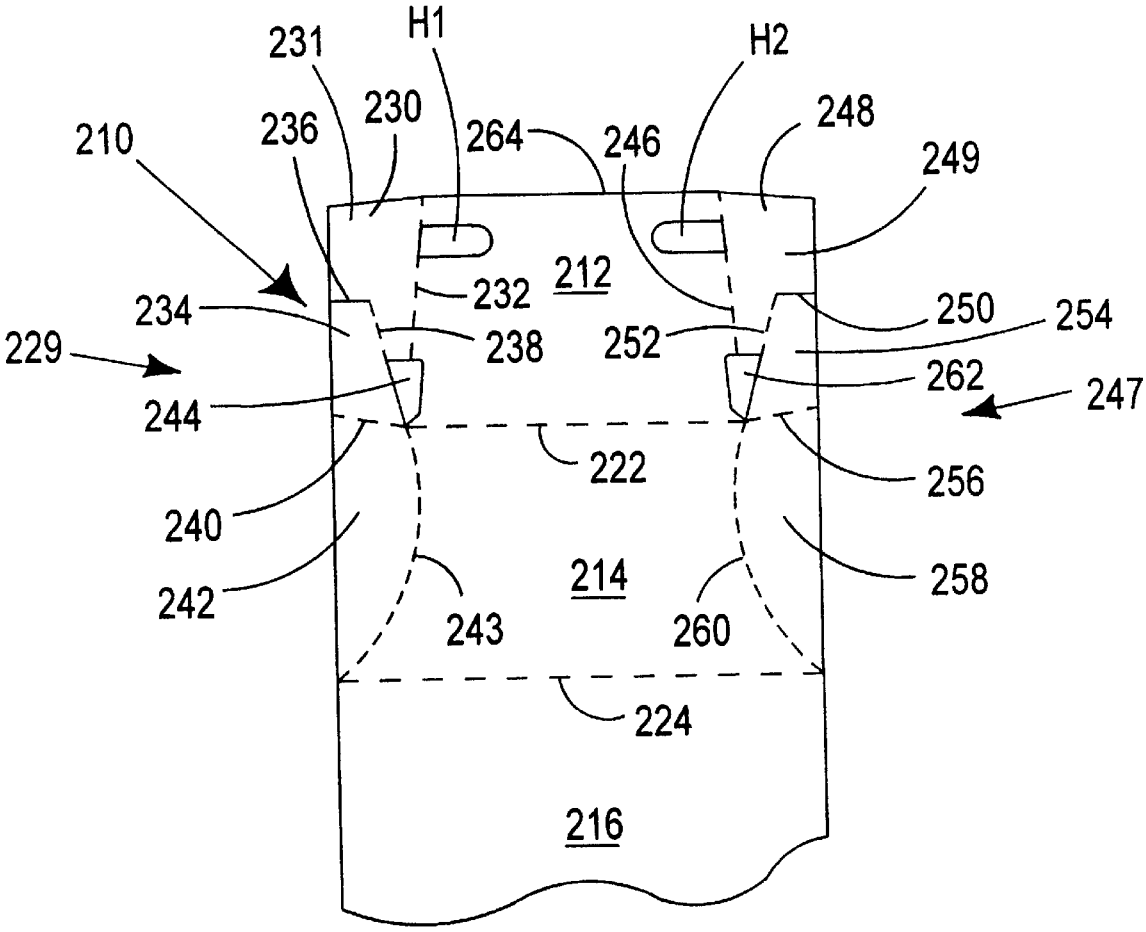
FIG. 8 illustrates a plan view of the printed face of a blank for forming a carton incorporating the arrangement according to an aspect of the invention.
Figure 9:
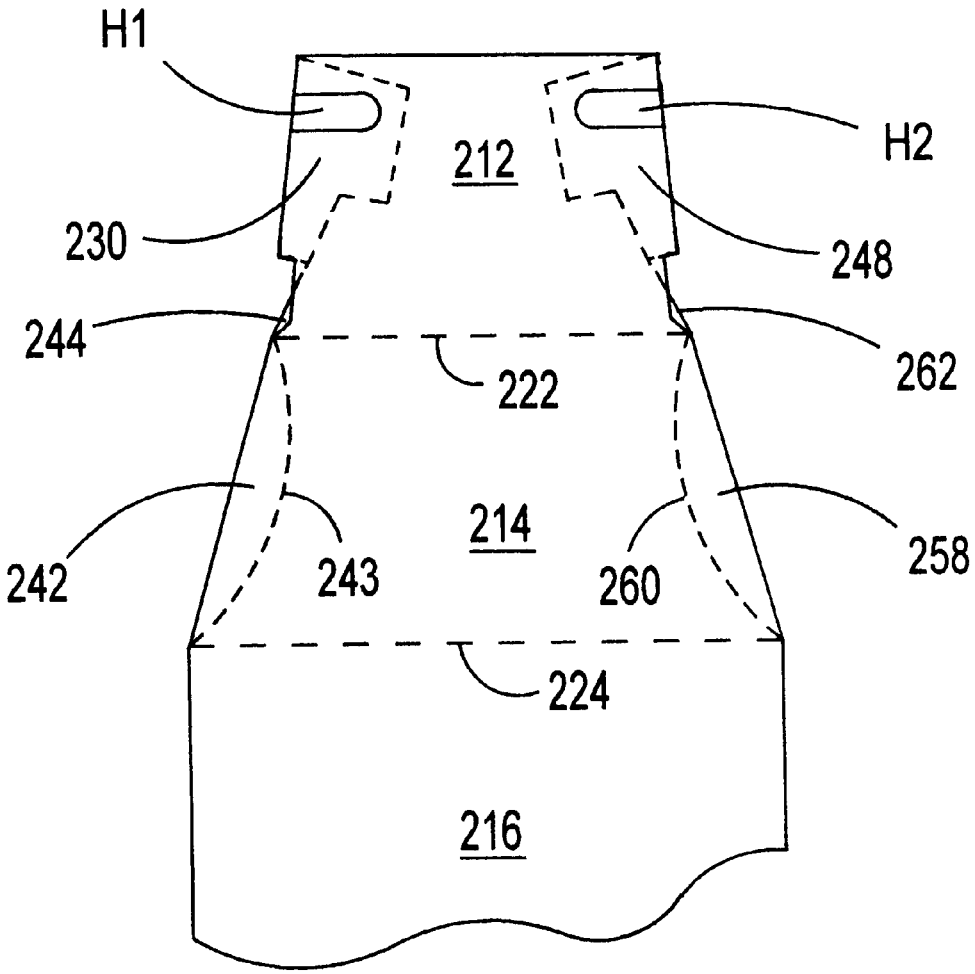
FIG. 9 illustrates a plan view of partially erected carton formed from the blank of FIG. 8.

Turning now to FIG. 8, there is shown part of an embodiment similar to the type described above made from paperboard or similar foldable sheet material incorporating another aspect of the invention. The blank 10 comprises a first base wall panel 212, a first side wall panel 214, a top wall panel 216, a second side wall panel 218 (FIG. 1), second base wall panel 20 hingedly connected one to the next along a plurality of fold lines.

Figure 11:
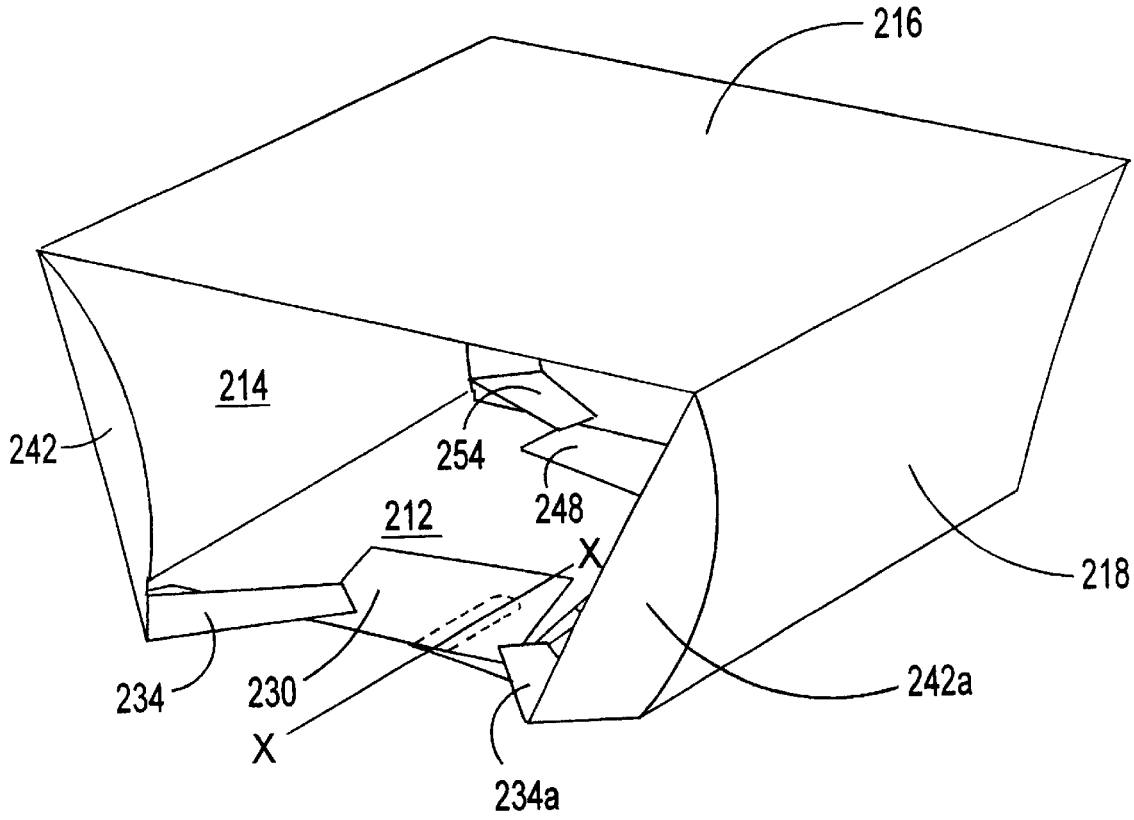
FIG. 11 illustrates the erected carton formed from the blank of FIG. 8.
Figure 12:
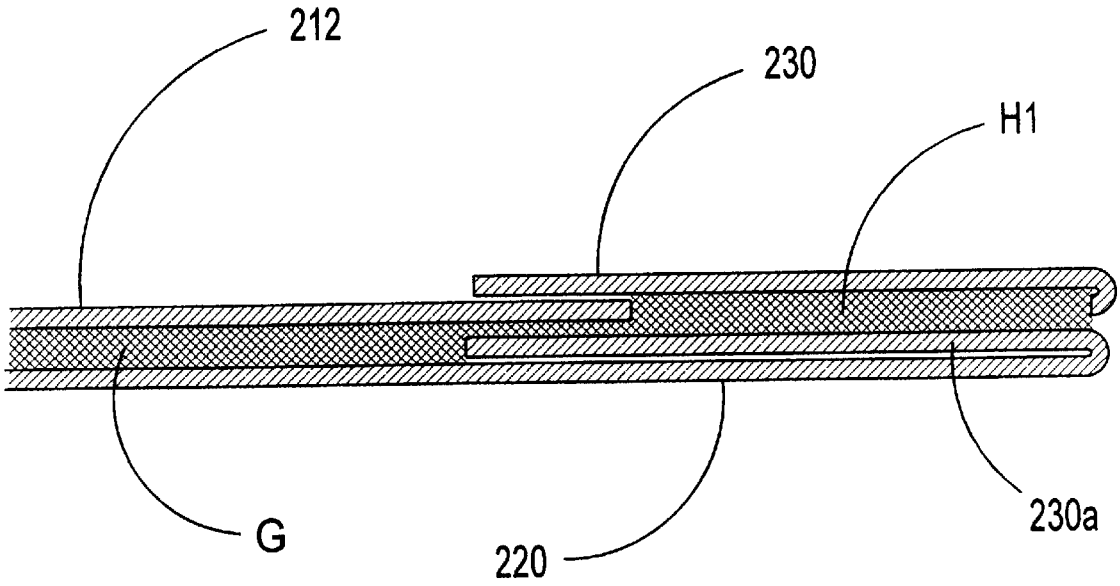
FIG. 12 is a cross section along the line X—X of FIG. 11.

In this embodiment, the arrangement for securing a triple ply structure is applied to an article retention arrangement of the carton shown in FIG. 11. The article retention arrangement 229 at one corner of side and base wall panels 212, 214 is substantially the same as the embodiments described above and illustrated in FIGS. 1 to 7 with like parts being designated by the same numeral, but prefixed with numeral "2".

Likewise, on the opposing side of base and side wall panels 212 and 214 there further comprises, in this embodiment, a similar article retention arrangement 247 to article retention arrangement 229 and is not therefore described in any greater detail.

In this embodiment, panel 212 is further provided with one or more elongate apertures H1, H2 formed proximate the free end of panel 12 and terminating along the fold lines 32 10 and 46 respectively. In other embodiments, alternative aperture shapes could be provided to correspond with differing panel configurations. The function of apertures H1 and H2 will be discussed in more detail below.

It will be seen from FIG. 1 that the end closure structures formed from panels 218 and 220 are designated by corresponding reference numerals with the addition of letter "a" because they are substantially identical to the end retention structures reformed from panels 212 and 214 described above, and are therefore not described in any more detail.

The function of the article retention structures is discussed above.

Turning to the construction of the carton from a carton blank as illustrated in FIG. 8, the blank 210 requires a series of sequential folding and gluing operations which are preferably performed in a straight line machine so that the carton is not required to be rotated or inverted to complete its construction. The folding process is not limited to that described below and can be altered according to particular manufacturing requirements. Each article retention structure is formed in a substantially like manner so only the construction of article retention structure 29 will now be described.

Thus, article retention structure 229 is formed by folding base end flap 230 about fold line 232 such that the base end flap is folded into face contacting relationship with base panel 212. This action causes gusset panel 234 to be folded out of alignment with base end flap 230 about fold line 238 and is drawn inwardly towards base wall panel 212 until a portion of the outer face of gusset panel 234 overlies base end flap 230. The position of base end flap 230 is shown by the broken lines in FIG. 9. As can be seen, the base end flap 230 now also overlies aperture H1. Likewise, after a similar folding operation, base end flap 248 overlies aperture H2. The other article retention structures are also formed in the same manner as described in the preceding paragraphs, however in this embodiment no apertures are present in base wall panel 220.

Figure 10:
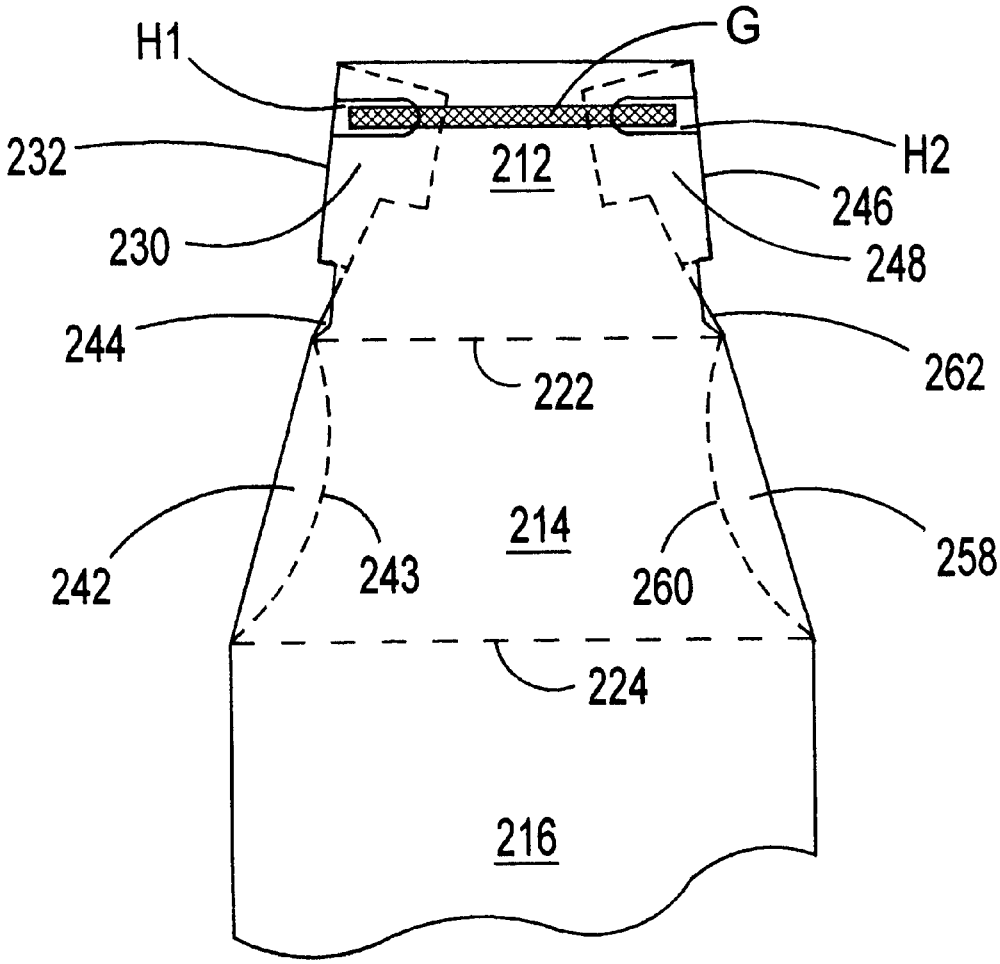
FIG. 10 illustrates a plain view of the partially erected carton of FIG. 9 in which glue has been applied to the arrangement.

Referring now to FIG. 10, a strip of glue G is, in this embodiment, applied in a substantially straight line from fold line 232 to fold line 246 of base wall panel 212 such that the glue is applied through the apertures H1 and H2 to the non-printed face of the base end flaps 230, 248 in addition to being applied along the printed face of base panel 212. In alternative embodiments, glue may be applied to different areas of the blank. Thereafter, the folding of side and base wall panels 212, 214 and 220, 218 is completed so that a portion of base wall panel 212 is placed in face contacting relationship with a corresponding overlapping portion 264 of base wall panel 220.

In this way, when the printed face of base wall panel 212 contacts the non-printed face of base wall panel 220 and the printed faces of base end flaps 230*a*, 248*a*, the entire carton, together with the end retention structures is secured together as shown in FIG. 11.

FIG. 11 shows the fully erected carton, in which the position of the apertures H1, H2, and the glue line G are shown in broken lines. It can be seen that the glue secures together base wall panels 212, 220 as well as base end flaps 230, 248, 230*a*, 248*a*. The arrangement is illustrated more clearly by the cross-sectional view of FIG. 12 in which the glue G can be seen bonding base end flaps 230 and 248 to base end flaps 230*a* and 248*a*, and base wall panel 212 to base wall panel 220.

In an alternative embodiment, further apertures (not shown) are provided on base end flaps 230*a*, 248*a* such that when the flaps are folded, and the two base wall panels 212, 220 are placed in face contacting relationship, the further apertures are in register with apertures H1, H2, and the glue therefore directly bonds base end flaps 230, 248 to the base panel 220.

The present invention and its preferred embodiment relates to an arrangement for securing together two outer panels and at least one inner panel, however it is anticipated that the invention can be applied to a variety of carriers, and is not limited to those of the wraparound type hereinabove described and could be used for numerous applications where three or more panels are to be secured in a face contacting relationship in which a single application of glue is used e.g. to secure a divider panel the interior of a carton.

It will also be recognised that as used herein, directional references such as "top", "base", "end" and "side" do not limit the respective panels to such orientation, but merely serve to distinguish these panels one from another. The terms "printed" and "non-printed" are merely used to distinguish one face of a panel from another, and do not limited the panels to having faces orientated in this manner. Furthermore, the term "panel" should, for the purposes of this application, be understood to mean any type of panel or flap which may form part of a carton or carton blank.

It will be recognised that rather than the top wall be formed from the secured panels, the carton blank may be re-arranged whereby some of the walls such as a top wall or side wall is formed from secured panels. Any reference to hinged connection should not be construed as necessarily referring to a single fold line only: indeed it is envisaged that hinged connection can be formed from one or more of one of the following, a score line, a frangible line or a fold line, without departing from the scope of invention.

The present invention and its preferred embodiment relates to an article carrier that is shaped to provide satisfactory strength to hold articles securely, but with a degree of flexibility so that during transit the articles are retained within the carrier. The shape of the blank minimises the amount of paperboard required and the carrier can be applied to an array of articles by hand or automatic machinery. It is anticipated that the invention can be applied to a variety of carriers and is not limited to those of the wraparound type hereinabove described. Further or alternatively, the carton may be adapted to carry a greater or lesser number of articles without departing from the scope of the invention.

What is claimed is:

1. An arrangement for securing a triple ply structure comprising an intermediate panel between a first panel and a second panel, wherein a first aperture is provided in said intermediate panel such that glue applied to an inner face of said first panel in register with said first aperture secures together said first, second and intermediate panels when placed together in face contacting relationship, wherein a third panel is disposed between said intermediate panel and said second panel, and wherein said third panel is provided with a second aperture in register with said first aperture such that said first panel is secured directly to said second panel.

2. The arrangement according to claim 1 wherein said first panel is provided by a folded portion of said intermediate panel, said folded portion at least partially overlying said aperture.

3. The arrangement according to claim 1 wherein said third panel is provided by a folded portion of said second panel.

4. The arrangement according to claim 3 wherein said second intermediate panel is further provided with an aperture in register with said first aperture such that said first panel is secured directly to said second panel.

5. An article carrier comprising a top wall, opposed side walls and a base wall hingedly connected together to form a tubular structure, wherein said base wall is a composite comprising an intermediate panel between a first panel and a second panel, wherein an aperture is provided in said intermediate panel such that glue applied to an inner face of said first panel in register with said aperture secures together said first, second and intermediate panels in face contacting relationship.

6. The article carrier according to claim 5 wherein said intermediate panel is a primary base panel hingedly connected to one of said side walls, and said second panel is a secondary base panel hingedly connected to the other of said side walls and disposed in an overlapping relationship with said primary base panel.

7. The article carrier according to claim 6 wherein said first panel is a base end flap hingedly connected to said primary base panel and folded into a face-contacting relationship with said primary base panel.

8. The article carrier according to claim 7 further comprising an article retention structure for retaining articles within said tubular structure, said retention structure comprising said base end flap, a side end flap hingedly connected to said one side wall and disposed in a folded position where said side end flap is in an angular relationship with said one side wall, and a gusset panel hingedly interconnecting said base end flap with said side end flap and disposed to overlie said base end flap to retain said side end flap in said folded position.

9. The article carrier according to claim 8 wherein said base end flap further comprises a tab shaped to be disposed between an article and said primary base panel to retain said side end flap in said folded position.

10. The article carrier according to claim 9 wherein said tab is defined by side and end edges of said base end flap and by a slit between said base end flap and said gusset panel, said slit terminating at a fold line connecting said base end flap to said gusset panel.

11. The article carrier according to claim 7 wherein said base end flap is connected to said primary base panel by a fold line defining an acute angle with a lower edge of said one side wall to maximize the length of said base end flap.

12. The article carrier according to claim 8 wherein a fold line connecting said side end flap to said gusset panel is angled with respect to an end edge of said one side wall to compensate for a panel arrangement in a set up condition thereby to maintain said gusset panel and said base end flap in a substantially flat arrangement with said base wall.

* * * * *